United States Patent [19]

Kaukeinen et al.

[11] 4,308,330

[45] Dec. 29, 1981

[54] COLOR ELECTROPHOTOGRAPHIC RECORDING ELEMENT

[75] Inventors: Joseph Y. Kaukeinen; Ernest W. Turnblom, both of Rochester, N.Y.

[73] Assignee: Eastman Kodak Company, Rochester, N.Y.

[21] Appl. No.: 122,968

[22] Filed: Feb. 20, 1980

Related U.S. Application Data

[60] Division of Ser. No. 847,464, Oct. 31, 1977, Pat. No. 4,228,231, which is a continuation of Ser. No. 695,351, Jun. 14, 1976, abandoned.

[51] Int. Cl.[3] ..... G03G 5/12; G03G 5/14

[52] U.S. Cl. ..... 430/46; 430/57; 430/64; 430/67

[58] Field of Search ..... 430/42, 45, 46, 57, 430/62, 64, 66, 67

[56] References Cited

U.S. PATENT DOCUMENTS 2,962,374 11/1960 Dessauer ..... 430/57
3,410,767 11/1968 Shepard et al. ..... 430/57
3,679,405 7/1972 Makino ..... 430/57
3,801,317 4/1974 Tanaka et al. ..... 430/57
3,992,204 11/1976 Taylor ..... 430/46

*Primary Examiner*—Richard L. Schilling
*Assistant Examiner*—John L. Goodrow
*Attorney, Agent, or Firm*—John D. Husser

[57] ABSTRACT

A subtractive color electrophotographic process is disclosed for producing a multicolor print from a single exposure of a color original. The process utilizes a novel multilayer recording element containing an electrically conducting layer, an insulating layer and two or more photoconductive layers, each spectrally sensitized to a different portion of the optical spectrum. In carrying out the process, the recording element is first uniformly charged and exposed to a color original and then developed by a multistep procedure. Each step of the development procedure comprises flood exposing the recording element to radiation to which at least one of the photoconductive layers is responsive while applying toner particles having a different subtractive color characteristic and an appropriate electrical bias.

3 Claims, 9 Drawing Figures

SIMULTANEOUSLY CHARGE TO 1000V AND EXPOSE TO COLOR ORIGINAL

| WHITE | BLACK | YELLOW | RED | 11 |
|---|---|---|---|---|
| | | | | 12 |
| | | | | 13 |
| 0 | 250 | 500 | 333 | 14 |
| 0 | 250 | 0 | 333 | 20 |
| 0 | 250 | 0 | 0 | 26 |
| 1000 | 250 | 500 | 333 | 30 |
| 1000 | 1000 | 1000 | 1000 | |

SURFACE POTENTIAL

FIG. 2b

BLUE LIGHT FLOOD AND DEVELOP YELLOW (BIAS SET AT 1000V)

| | WHITE | BLACK | YELLOW | RED | |
|---|---|---|---|---|---|
| | | | | | 12 |
| | | | | | 13 |
| | 0 | 0 | 0 | 0 | 14 |
| | 0 | 250 → 333 | 0 → 167 | 333 → 444 | 20 |
| | 0 | 250 → 333 | 0 → 167 | 0 → 111 | 26 |
| | 1000 | 250 → 333 | 500 → 667 | 333 → 444 | 30 |
| SURFACE POTENTIAL | 1000 | 750 → 1000 (Y) | 500 → 1000 (Y) | 666 → 1000 (Y) | |

FIG. 2c

CYAN LIGHT FLOOD AND DEVELOP MAGENTA (BIAS SET AT 834V)

| | WHITE | BLACK | YELLOW | RED | |
|---|---|---|---|---|---|
| | | | | | 12 |
| | | | | | 13 |
| | 0 | 0 | 0 | 0 | 14 |
| | 0 | 0 | 0 | 0 | 20 |
| | 0 → -83 | 333 → 417 | 167 | 111 → 250 | 26 |
| | 1000 → 917 | 333 → 417 | 667 | 444 → 583 | 30 |
| SURFACE POTENTIAL | 1000 → 834 | (Y) 666 → 834 (M) | (Y) 834 | (Y) 555 → 834 (M) | |

WHITE LIGHT FLOOD DEVELOP CYAN (BIAS SET AT 583V)

| WHITE | BLACK | YELLOW | RED |
|---|---|---|---|
| | | | |
| | | | |
| 0 | 0 | 0 | 0 |
| 0 | 0 | 0 | 0 |
| 0 | 0 | 0 | 0 |
| 917 → 583 | 417 → 583 | 667 → 583 | 583 |
| | Y M | Y | Y M |
| SURFACE POTENTIAL 917 → 583 | 417 → 583 | 667 → 583 | 583 |
| | C | | |

FIG. 2d

COLOR ELECTROPHOTOGRAPHIC RECORDING ELEMENT

This is a division of application Ser. No. 847,464, filed Oct. 31, 1977, now U.S. Patent 4,228,231 which is a continuation of application Ser. No. 695,351, filed June 14, 1976 now abandoned.

BACKGROUND OF THE INVENTION

1. Field of the Invention

The invention relates to color electrophotography and, more particularly, to an electrophotographic process, element and apparatus for producing on a single support a self-registered, multicolored image from a single exposure of a color original.

2. Description of the Prior Art

The well known and basic xerographic process can be adapted to produce multicolor reproductions by first color separating the original document to be reproduced into its primary color components red, green and blue. Each color component is then used to record a separate latent electrostatic image on the surface of a photoconductive element. The recorded red, green and blue images are developed using toners containing subtractive colorants that are complements of the primary colors recorded, i.e., cyan, magenta and yellow, respectively. Finally, each developed image is individually transferred from the photoconductive element to a final support material to produce a multicolor reproduction of the original. One disadvantage of this process is that the formation of color separations is an expensive and tedious operation. Another disadvantage is that multiple exposure and transfer operations are required, which operations must be in precise registration in order to produce high quality prints.

A subtractive color electrophotographic process which eliminates the need to form color separations is disclosed in U.S. Pat. No. 2,962,375 to Schaffert. In accordance with the teachings of this reference, a plurality of photoconductive layers, each conductively sensitive to light of a different primary color are superimposed one on top of the other. A light image of a color original is projected onto the array of photoconductors from one side thereof so that the wavelengths of the exposing light selectively pass through the first of the photoconductors in reaching the last of the photoconductors. An electric field is applied through the photoconductive layers while they are exposed in this manner so as to produce a plurality of developable electrostatic latent images which are developed with a toner of the color complementary to the primary light of the exposure. While the Schaffert process requires only a single exposure of the original, registration is still a problem since each of the developed images must still be individually transferred to a final receiving support.

U.S. Pat. No. 3,702,483 to Fantuzzo discloses an electrophotographic method for producing a color reproduction of an original employing a single exposure and a single transfer operation. In this method, a color original is exposed to a uniformly charged photoconductive layer. The original contains colors having reflective characteristics that are capable of selectively discharging the photoconductive surface to discrete charge density levels so that each color is recorded thereon at a discrete charge potential. The photoconductive layer is then transported through a developing station containing a plurality of developing units equal in number to the number of discernible colors in the original. Each developing unit has an electrical control means associated therewith so that only color components recorded at or above a predetermined potential are developed within the unit. The recorded images are developed in a descending order of magnitude and the final color rendition is then transferred in a single operation to a sheet support material. One disadvantage of the Fantuzzo method is that it cannot faithfully reproduce originals comprised of colors which reflect or transmit similar quantities of light onto the photoconductor. Another disadvantage is that some residual voltage remains in the developed regions which, in some cases, may be sufficient to attract additional toner in subsequent developing units, thereby altering the color balance of the reproduction.

Another electrophotographic method for producing a color reproduction of an original which requires only a single exposure and a single transfer operation is discloses in U.S. Pat. No. 3,836,363 to Plutchak. The Plutchak reference utilizes a recording element comprising a multicolor additive filter mosaic sandwiched between two pan-sensitive photoconductive layers. To carry out the process, one photoconductive layer of the recording element is uniformly charged and imagewise exposed to a color original through the mosaic. The resulting electrostatic latent image is developed with an opaque toner. The other photoconductive layer is then uniformly charged, exposed through the opaque toner bearing surface of the first photoconductive layer and the mosaic, and developed three successive times using red, green and blue exposing lights and cyan, magenta and yellow toners, respectively. The resulting color image is then transferred to a final receiver sheet. One disadvantage of the Plutchak reference is that a high quality filter mosaic is required which increases the manufacturing costs of the recording element. Furthermore, use of a mosaic requires controlled smearing of either the exposure or transfer operation of the process in order to produce a faithful color reproduction.

SUMMARY OF THE INVENTION

It is, therefore, an object of the present invention to provide an improved electrophotographic process for producing subtractive multicolor images utilizing a single exposure of a color original and a single transfer operation.

Another object of the invention is to provide a color electrophotographic process which avoids the requirement of smearing the image during one of the process steps.

A further object of the invention is to provide a novel recording element and apparatus useful in the color electrophotographic process of the invention.

These and other objects are accomplished in accordance with the present invention using a novel electrophotographic recording element comprising a transparent, electrically conducting support material (or, alternatively a transparent support coated with a transparent conducting layer), an electrically insulating layer and at least two photoconductive layers selectively sensitive to activating radiation of different wavelengths.

To carry out the novel process of the invention, the recording element is uniformly charged and exposed to a color original. The photoconductive layers are then successively discharged by successively flood exposing the recording element to the radiation to which the photoconductive layers are selectively sensitive. Simultaneously with or subsequent to each flooding exposure step, a toner having a particular subtractive color characteristic is applied to the recording element in combination with an appropriate electrical bias. The term "subtractive color characteristic" as used herein with respect to a marking particle, e.g., a toner, is intended to include both particles having a subtractive color colorant and particles having the ability to form a subtractive color in a subsequent step.

The above-described multistep development procedure forms a multicolor image on the insulator layer comprised of a plurality of superimposed subtractive color images which is then transferred in a single operation to a final receiver.

The invention provides an electrophotographic process utilizing a recording element which can be readily manufactured by techniques known in the art to produce full color images with a single exposure of the original and a single transfer operation. The process may be utilized to form a camera original or a reproduction of a color document. The process may also be used in a reversal mode to form an internegative or color mask.

The invention also provides a unique electrophotographic apparatus for effecting the aforedescribed color recording procedure.

The invention, its objects and advantages will become more apparent to those skilled in the art by referring to the accompanying drawings wherein like parts are designated by like reference numerals and to the ensuing detailed description of the preferred embodiment.

BRIEF DESCRIPTION OF THE DRAWINGS

FIGS. 2*a*–2*d* schematically illustrate the sequential steps of the inventive process;

DETAILED DESCRIPTION OF THE PREFERRED EMBODIMENTS

Figure 1:
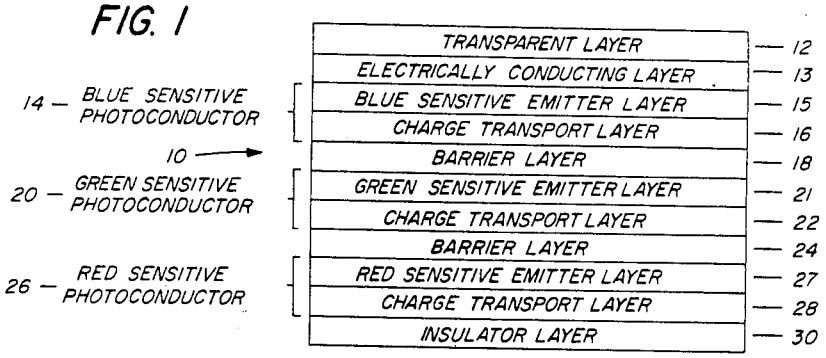
FIG. 1 is a cross section of an illustrative multilayer recording element useful in carrying out the process of the invention.

A recording element useful in the present invention can be fabricated in a number of alternative configurations. The optimum recording materials and configuration of an element will depend upon such factors as the source of activating radiation used, the desired image and the like. A typical recording element configuration useful in the process of the invention comprises an electrically conductive support or, alternatively a support coated with a conducting layer, the support or conducting layer having thereon an electrically insulating layer and at least two photoconductive layers conductively sensitive to different portions of the optical spectrum, i.e., the ultraviolet, visible and infrared portions of the electromagnetic spectrum. The photoconductive layers and the insulating layer can be arranged on the conducting layer in any desired order, for example, to optimize the recording process in view of unwanted absorption in one or more of the photoconductive layers. Preferably, the recording element is a unitary structure formed of a plurality of adhered layers although the layers can be formed separately if desired and then sandwiched together during the recording process.

A variety of photoconductive layers which absorb light of primarily only one wavelength or group of wavelengths and are substantially transparent to light of other wavelengths are useful in the described recording element. The photoconductive layers can be formed from both organic and inorganic materials. Organic materials have been found especially useful including homogeneous organic photoconductive compositions containing, for example, an organic photoconductive polymer or a solid solution of an organic photoconductor in a polymeric binder. Other especially useful organic photoconductive materials are the "heterogeneous" or "aggregate" photoconductive compositions such as described in U.S. Pat. No. 3,615,414 issued Oct. 26, 1971, to Light and in Berwick et al U.S. patent application Ser. No. 639,039 filed Dec. 9, 1975, the disclosures of which are incorporated herein by reference. Still another especially useful type of organic photoconductive material includes mixtures of one or more organic photoconductive pigments dispersed in a polymeric binder. A photoconductive layer useful in the described recording element can be formed as a single layer member or as a multilayer member as described in the aforementioned Berwick et al application. Preferably, the photoconductive layers contained in the recording element are regenerative and of matched speed, i.e., the layers have an approximately equal photosensitive response when illuminated with light of a color to which they are selectively sensitive. In a particularly preferred embodiment of the invention, the recording element contains three regenerative, matched speed photoconductive layers which are respectively blue-light sensitive, green-light sensitive and red-light sensitive. In alternative embodiments the layers can be selectively sensitive to light in other portions of the visible spectrum as well as to the ultraviolet and infrared portions of the optical spectrum.

A multilayered unitary recording element can be manufactured by a variety of well known techniques, including lamination, solvent coating and a combination of solvent coating and lamination. When the process for manufacturing the recording element includes the steps of solvent coating two adjacent selectively-conductive photoconductor layers, the recording element preferably further includes a transparent barrier layer such as a cellulose nitrate layer between the adjacent photoconductive layers. For such solvent coated recording elements, the cellulose nitrate layer has been found to provide useful chemical barrier properties between each of the separate photoconductive components of the recording element, for example, solvent hold-out. The cellulose nitrate layer may also reduce the electrical charge migration and enhance the storage properties of the recording element.

If one or more of the selectively sensitive photoconductive layers do not have the desired absorption spectrum, the recording element may also include one or more filters to compensate for this unwanted absorption. The filter or filters may be formed as a separate layer or incorporated into the appropriate photoconductive layer or into the cellulose nitrate barrier layer. In the latter instance, a single interlayer can serve all three of the above-noted functions, i.e., as the filter layer, the chemical barrier layer and the electrical barrier layer.

A particularly useful recording element is illustrated in FIG. 1. As shown, the recording element 10 includes a transparent polyester film support 12 coated with a transparent electrically conducting layer 13. Adjacent the conducting layer 13 is a first photoconductor 14 which absorbs light primarily in the blue region of the visible spectrum and is substantially transparent to wavelengths of the other two primary colors. The photoconductor 14 is of composite structure and comprises a blue-sensitive emitter layer 15 and a charge transport layer 16 having a yellow filter material incorporated therein. Since the recording element 10 is manufactured using solvent coating techniques, a transparent barrier layer 18, such as cellulose nitrate, is coated on top of the charge transport layer 16. Adjacent the layer 18 is a second composite photoconductor 20 which absorbs light primarily in the green region of the visible spectrum and is substantially transparent to light in the red region of the spectrum. Photoconductor 20 comprises a green-sensitive emitter layer 21 and a charge transport layer 22 having a magenta or red filter material incorporated therein. Another barrier layer 24 is coated between the charge transport layer 22 and a third composite photoconductor 26 comprising a red-sensitive emitter layer 27 and a charge transport layer 28 and having a peak sensitivity in the red region of the visible spectrum. Electrically insulating layer 30 heat laminated onto the layer 28 completes the recording element 10. If the insulating layer 30 is solvent coated onto the charge transport layer 28 another barrier layer would be coated between the layers 28 and 30.

It is to be noted that the above-listed order of the three selectively-conductive photoconductors 14, 20 and 26, respectively, is illustrative only and other combinations could be used if desired or required for optimization of the process. If a two-color system is desired, one of the selectively-conductive photoconductors can be omitted from the recording element 10. Furthermore, the yellow filter material is included in the charge transport layer 16 to compensate for the unwanted sensitivity of the green-sensitive photoconductor 20 and, to a lesser degree, of the red-sensitive photoconductor 26 to blue light. Similarly the magenta or red filter material is included in the charge transport layer 22 to compensate for the unwanted sensitivity of the red-sensitive photoconductor 26 to green light. If the photoconductive elements used in the recording element 10 are conductively sensitive to light of only one primary color to the substantial exclusion of sensitivity to light of the other two primary colors, then the filter materials can be eliminated from the recording element structure.

To use the recording element described above to produce a multicolor image, the recording element is uniformly charged while being exposed to a color original and then successively developed three times by flood exposing the recording element to blue, cyan and white light and applying three toners having different subtractive color characteristics in combination with appropriate electrical biases. With the illustrative recording element shown in FIG. 1, both the flooding and exposing steps are done through the transparent support 12. In alternative recording elements the exposure and/or flooding steps can be done through a transparent insulating layer.

In the preferred embodiment of the invention the toners contain cyan, magenta and yellow colorants that are predominantly spectrally absorptive of the red, green and blue light to which the photoconductive layers of the recording element are selectively sensitive. Alternatively, the toners may be colorless and contain a dye coupler and a catalyst which react with a photographic developing solution to form a multicolored image. In still other embodiments the toners may be nucleated or sensitized in a manner which allows them to form color images in a subsequent development or amplification procedure. It is important to note that the process of the invention does not require the above-described or any predetermined sequence of flooding or toner applying steps to be followed. The flooding and/or toner applying steps can be arranged in any desired sequence, for example, in order to optimize the recording process in view of the particular absorption characteristics of the recording element. Furthermore, the process does not require the above-described combination of blue, cyan and white flooding lights. Other combinations of flooding lights can be used which selectively discharge one or more photoconductive layers, for example, blue, green and red flooding lights. The blue, cyan and white combination is preferred because it first discharges the blue-sensitive photoconductor, then discharges the blue and green-sensitive photoconductors and finally discharges all three photoconductors. This discharging sequence provides the greatest flexibility in selecting the other process parameters.

The aforementioned steps of the novel process of the invention are schematically illustrated in FIGS. *2a–2d*. To aid the reader's understanding of how a multicolored image is formed, the process will be explained in the succeeding paragraphs in conjunction with an idealized three-color recording element. The assumptions of the idealized recording element are as follows:

(1) the photoconductive layers and the insulating layer of the recording element all have the same capacitance;

(2) the voltage across each of the photoconductive layers is reduced to or maintained at zero when exposed in its maximum absorption region without affecting the other photoconductive layers;

(3) when the recording element is developed, all the potential difference available for development is utilized to attract toner until the electric field in the development zone is neutralized;

(4) during each development step, the dielectric layers of the recording element (i.e., the insulating layer and photoconductive layer or layers in a nonconducting state) recharge to voltage which in sum are equal in magnitude to the developing bias voltage applied to the recording element, the potential difference between the bias voltage and the total dielectric layer voltage across the recording element after exposure being divided equally among such dielectric layers since they are of equal capacitance; and (5) electrical charges migrate across the layer interfaces when an external voltage is applied to the recording element, but store across such layers when the voltage is removed.

As will be noted, the conductive layer 13 of the recording element 10 is connected to a reference potential during the three development steps of the process and the three development heads are grounded. Alternatively the conductive layer 13 can be maintained at ground potential during development with an appropriate electrical bias applied to each of the three development heads. Also the flooding light exposures are made prior to and simultaneously with the developing steps to prevent recharging in the photoconductive layer or layers being flooded. Alternatively the photoconductive layers can be flooded only prior to development in which case the flooded photoconductive layer or layers as well as the other dielectric layers of the recording element in a nonconducting state recharge during the development steps.

The first step of the process is to uniformly charge and expose the recording element 10 to a color original 11. Preferably such charging and exposure occurs simultaneously since it results in the creation of a uniform surface potential on the insulating layer, which potential comprises a unique series of interlayer charge patterns distributed across the photoconductive and insulating layers that are representative of each color component in the original, the patterns in total forming a stored; multicolor latent image within the recording element. Alternatively, the charging and exposure can be performed as separate steps of the process. This procedure will produce the requires unique series of interlayer charge patterns distributed across the photoconductive and insulating layers of the recording element, however, the surface potential on the insulating layer will be non-uniform. One potential disadvantage of this procedure is that the range of useful biasing voltages applied in the toner applying steps may be limited.

The charge distribution pattern formed by charging and simultaneously exposing the idealized recording element 10 to a color original 11 comprising white, black, yellow and red areas is shown in FIG. *2a*. For the purposes of illustration, the uniform charge is shown to be of a positive polarity, of a magnitude of 1,000 volts and to be produced by a conventional corona charger unit 32. In the idealized three-color recording element the surface potential on the insulating layer is a uniform 1,000 volts; however, the distribution of that charge across each of the three photoconductive layers and the insulating layer will vary uniquely in accordance with each color component in the original 11. As illustrated, the red portion of the original dissipates the charge only in the red-sensitive photoconductor 26. The 1,000 volt potential applied by the corona charger 32 is, therefore, divided equally between the blue-sensitive photoconductor 14, the green-sensitive photoconductor 20 and the insulating layer 30 so that the potential across each of these components is approximately 333 volts. Light from the yellow portion of the original dissipates charge in both the green and red-sensitive photoconductors, 20 and 26, respectively. As a result, the 1,000 volt applied potential is divided equally between the blue-sensitive photoconductor 14 and the insulting layer 30. Where white light strikes the recording element 10, the charge is dissipated from all three photoconductors so that the full 1,000 volt potential appears across the insulating layer 30. In the black areas, no light strikes the recording element 10 and the potential across each of the four layers 14, 20, 26 and 30, respectively, is approximately 250 volts.

After being uniformly charged and exposed to a color original, the recording element 10 is uniformly flooded with blue light to dissipate the charge on the blue-sensitive photoconductor 14. A developing bias of 1,000 volts positive with respect to the conducting layer 13 is then applied to the developing head 72 while maintaining the blue flood exposure and the recording element is developed with positively charged yellow colored toner particles forming a blue separation toner image of the original. A section of the insulating layer 30 will receive the yellow colored toner particles during development if the surface potential of that section (which is equal to the sum of the potentials across the photoconductors 20 and 26 and the insulating layer 30) is less than that of the bias potential. However, if the surface potential is equal to or greater than the bias potential then no yellow colored toner particles will be deposited. As shown in FIG. *2b*, the areas of the insulating layer 30 corresponding to the black, yellow and red areas of the transparency 11 initially all have a surface potential of less than 1,000 volts as a result of the blue light flooding and receive yellow colored toner particles whereas the area of the insulating layer 30 corresponding to the white area of the original 11 has a surface potential equal to 1,000 volts and therefore receives no toner. During the yellow development procedure, the portions of the recording element 10, in which the sum of the interlayer potentials is reduced below the 1,000 volt charging level as a result of the blue light flooding, recharge to the 1,000 volt bias level dividing the difference in potential between the initially blue exposed and recharged states equally between the green-sensitive photoconductor 20, the red-sensitive photoconductor 26 and the insulating layer 30. Thus the area of the recording element 10 corresponding to the black area of the original recharges from 750 to 1,000 volts, dividing the 250 volt potential difference available for yellow development equally among the red-sensitive photoconductor 26, the green-sensitive photoconductor 20 and the insulating layer 30 (i.e., the voltage across these layers increases from 250 to 333 volts). Similarly the areas of the recording element 10 corresponding to the yellow and red areas of the original recharge from 500 and 667 volts, respectively, to 1,000 volts and divide the 500 volt potential difference and the 334 volt potential difference available for yellow development equally among the green-sensitive photoconductor 20, the red-sensitive photoconductor 26 and the insulating layer 30 (i.e., in the area of the recording element corresponding to the yellow area of the original 11, the voltage across the green-sensitive photoconductor 20 and the red-sensitive photoconductor 26 increases from 0 to 167 volts while the voltage across the insulating layer 30 increases from 500 to 667 volts. In the area of the recording element corresponding to the red area of the original, the voltage across the green-sensitive photoconductor 20 and the insulating layer 30 increases from 333 volts to 444 volts while the voltage across the red-sensitive photoconductor 26 increases from 0 to 111 volts.)

Next, as shown in FIG. *2c*, the recording element 10 is uniformly flooded with cyan light which insures that the blue-sensitive photoconductor layer 14 is maintained at zero voltage and dissipates the voltage across the green-sensitive photoconductor 20. A developing bias of 834 volts positive with respect to the conducting layer 13 is then applied to the development head 76 while maintaining the cyan flood exposure. The recording element is developed with positively charged magenta colored toner particles, forming a green separation toner image of the original superimposed exactly in register with the previously formed blue separation. The 834 volt bias potential is equal to the surface potential in the area of the insulating layer 30 corresponding to the yellow area of the original and is less than the initial surface potential in the area of the insulating layer corresponding to the white area of the original and, therefore, no magenta colored toner particles are deposited in these areas. Magenta colored toner particles are deposited, however, in the areas of the insulating layer 30 corresponding to the black and red areas of the original since these areas initially have a surface potential of less than 834 volts. Again, during development, the areas of the recording element 10, wherein the sum of the interlayer potentials is reduced below the 834 volt bias level as a result of the cyan flooding, i.e., those areas corresponding to the black and red areas of the original, charge up to the bias potential level dividing equally the potential difference available for magenta development between the red-sensitive photoconductor 26 and the insulating layer 30. However, the area of the recording element 10 corresponding to the white area of the original is initially at 1,000 volts and must discharge to reach the 834 volt bias level. This discharge is also equally divided between the two layers 26 and 30 with the insulating layer 30 dropping to 917 volts and the red-sensitive photoconductor 26 acquiring a negative charge of 83 volts.

Figure 2A:
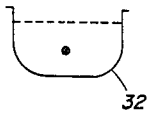
Figure 3:
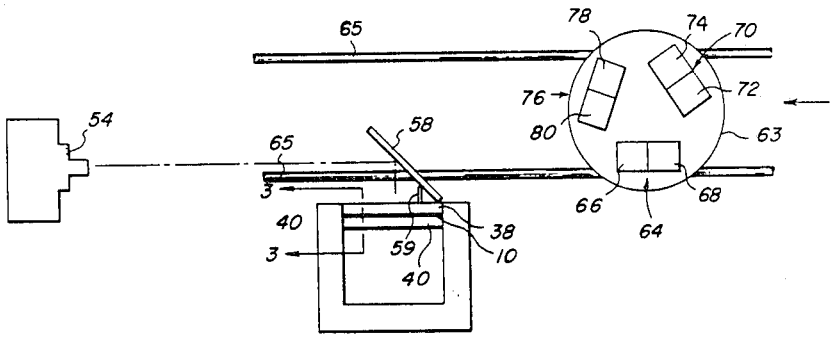
FIG. 3 schematically illustrates a top plan view of an automatic apparatus for carrying out the inventive process.
Figure 3A:
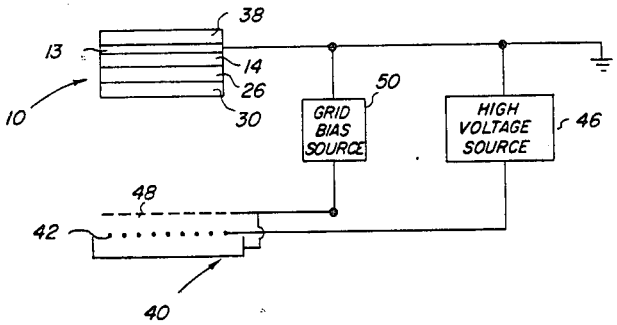
FIG. 3*a* is a cross sectional view taken along line 3—3 of FIG. 3 showing the corona charging mechanism in greater detail.

Finally, as shown in FIG. 2*d*, a red separation toner image of the original is formed on the insulating layer 30 by uniformly flooding the recording element 10 with white light which discharges all three photoconductors while simultaneously applying positively charged cyan colored toner particles in combination with a bias voltage of 583 volts positive with respect to the conducting layer 13. This red separation toner image is again in exact registration to the previous two color separations. Cyan colored toner particles are deposited in the area of the insulating layer 30 corresponding to the black area of the original since the surface potential is initially less than 583 volts. No cyan colored toner particles, however, are deposited in the other areas of the insulating layer since the surface potential in these areas is equal to or above the bias potential. As a result of the three development steps, the area of the insulating layer 30 corresponding to the black area of the original 11 contains superimposed yellow, magenta and cyan toner deposits, the area corresponding to the red area of the original contains yellow and magenta toner deposits, the area corresponding to the yellow area of the original contains only yellow toner and the area corresponding to the white area has no deposited toner. This three-color positive-to-positive image can be transferred from the insulating layer 30 to any suitable receiver by techniques known in the art and fixed thereon. The recording element 10 can then be prepared to be recycled through the process steps illustrated in FIGS. 2*a*–2*d* to produce another color print by cleaning residual toner particles remaining on the insulating layer 30 and then reverse charging the recording element 10 with the corona charger set at 0 volts while flooding the recording element 10 with white light.

It should be noted that in the development of the idealized recording element, different potentials are available for different toners and this difference may affect the color balance of the resulting image. For example, in forming the red image on the insulating layer 30, a potential of 333 volts is available for yellow development (the 1,000 volt bias potential less the total interlayer potential of 666 volts) and 279 volts is available for magenta development (the 834 volt bias potential less the total interlayer potential of 555 volts). To provide better color balance in the image, the capacitance of each of the photoconductors could be individually selected and/or a different combination of biasing potentials utilized.

The practical operability of the process described above is illustrated by the following examples. It is to be understood, however, that the parameters and materials disclosed therein are illustrative only, and hence are not meant to limit the invention in any way.

EXAMPLE 1

A multilayer recording element comprising two photoconductive layers selectively conductive to light of different wavelengths was fabricated in the following manner. A blue-sensitive photoconductive layer was prepared by adding 2.25 grams of dibenzothiophene formaldehyde resin, 2.25 grams Vitel 101 (a polyester manufactured by the Goodyear Rubber Company), 1.5 grams of 2,4,7-trinitro-9-fluorenone and 0.75 ml of a 10% solution of poly(bisphenol A-block copolydimethylsiloxane sebacate) in dichloromethane to 35.1 grams of dichloromethane. After the components had been dissolved, the composition was coated on a transparent, electrically conducing film support subbed with a thin layer of a polymeric adhesive using a 0.004 inch (100 micrometer) coating knife. The resulting coating was dried in an oven at 90° C. for 15 minutes. A barrier layer was then prepared by dissolving 0.26 grams of cellulose nitrate in 0.8 grams n-butanol and 9.2 grams methanol. This composition was coated on the blue-sensitive layer described above.

A red-sensitive photoconductive layer was formed by adding 0.494 grams of 4-(4-dimethylaminophenyl)-2,6-diphenylthiapyrylium fluoroborate, 29.7 grams Lexan 145 (a polycarbonate from General Electric Co.) and 19.7 grams 4,4'-bis(diethylamino)-2,2'-dimethyl triphenylmethane to 200 grams of dichloromethane. After shearing in a blender for 75 minutes, the composition was coated on the above-described barrier layer and dried at 60° C. for 16 hours. Finally, a subbed 0.0005 inch (12.5 micrometer) Mylar film (polyethylene terephthalate manufactured by E. I. du Pont de Nemours & Co.) was heat laminated to the red-sensitive photoconductive layer to serve as the insulator overcoat.

Figure 4:
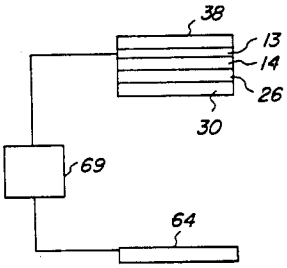
FIG. 4 is a side elevational view of the apparatus.
Figure 4A:
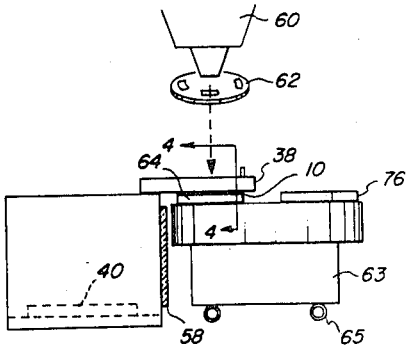
FIG. 4*a* is a cross sectional view taken along line 4—4 of FIG. 4 showing the development and rinse voltage biasing mechanism in greater detail.

Two positive-to-positive, two-color prints were made with this two photoconductive layer recording element using the apparatus shown in FIGS. 3, 3*a*, 4 and 4*a*. To produce the prints, the recording element was placed on a transparent platen 38 and uniformly charged to a positive potential of approximately 1250 volts with respect to the conducting layer 13 by a grid controlled corona charger unit 40 comprising a plurality of corona wires 42 surrounded on one side by an electrically conducting yield shield 44 and on the other side by a wire grid 48. Both the shield and grid were were connected to a bias voltage source 50. The corona wires 42 were connected to the high voltage source 46. Simultaneously with charging, the recording element was exposed by projecting a color original with light provided by a xenon source 54 (a Xenographic 500 projector manufactured by the Optical Radiation Corporation). The color original consisted of adjacent bands of blue and red Kodak Wratten filters along with clear and dark regions. A spring biased mirror 58 positioned by a pin 59 mounted on the platen 38 intercepts the light image of the original and reflects such image through the platen 38 and onto the recording element 10. As shown in FIG. 4, the charger unit 40 was then pivoted in a downwardly direction to the retracted position shown in phantom and the platen 38 carrying the recording element 10 thereon was pivoted in an upwardly direction to a position overlaying the path of movement of a movable carriage 63. Concurrent with the movement of the platen 38, the mirror 58, no longer supported by the pin 59, pivoted to an inoperative position spaced from the path of movement of the carriage 63. The recording element was then flooded with red light provided by projecting white light from a second xenon source 60 (a Xenomega Pro-Lab enlarger manufactured by the Berkey Photo Corporation) positioned above the platen 38 through a red filter contained in a filter wheel 62 and the platen 38 and onto the recording element. While maintaining the red flooding light, the carriage 63 having three development stations 64, 70 and 76, respectively, mounted thereon was moved along rods 65 such that the development station 64 was passed in close proximity to the Mylar insulating layer 30 of the recording element. The development station 64 comprised a liquid development head 66 containing positively charged cyan colored toner particles in Isopar G (a trademark of Exxon used to designate an isoparaffinic hydrocarbon liquid of very high purity having a boiling range of about 145° C. to about 185° C.) and a rinse head 68 containing Isopar G. Each of the head 66 and 68 is constructed with small alternating channels in a flat metal surface to allow the liquid to flow in, across the flat surfaces and drain away. With a negative electrical bias of 1100 volts applied to the conducting layer 13 of the recording element from a source 69, the development head 66 grounded and a positive electrical bias of 1080 volts applied to the rinse head 68, cyan colored toner particles were deposited on the insulating layer in the areas corresponding to the blue and dark regions of the original. The filter wheel 62 was then rotated to position a blue filter in the light beam provided by the xenon source 60. While maintaining the blue flooding light, the carriage 63 was rotated in a counterclockwise direction so that the development station 70 was positioned to pass adjacent the insulating layer 30. The development station 70 is identical to the development station 64 except that the development head 72 contained positively charged yellow colored toner particles in Isopar G. With negative electrical bias of 1,000 volts applied to the recording element, the development head 72 grounded and a positive electrical bias of 980 volts applied to the rinse head 74, yellow colored toner particles were deposited on the insulating layer in the areas corresponding to the red region and the dark region of the original. The resulting images were thus composed of cyan, yellow and green toner deposits corresponding to the blue, red and dark regions of the original and no toner deposits in the area corresponding to the clear region of the original. The only difference in the two prints was the method of transferring the images to a final receiving support; one transfer was electrostatic and the other transfer was adhesive. Pertinent data for the processing of the recording element is listed below:

Exposure:

(a) Intensity of the Xenographic projector—power of density at the exposure plane was 5,200 microwatts/cm$^2$, (b) Permanent filters—a Kodak Wratten No. 2B filter and a 725 nanometer (nm) interference cutoff filter were permanently positioned in the light beam of the Xenographic projector, (c) The color original (1) The blue portion of the original comprised two thicknesses of a Kodak Wratten No. 47B filter, (2) The red portion of the original comprised a Kodak Wratten No. 70 filter, (3) The clear portion of the original comprised a Kodak Wratten No. 96 filter (1.0 ND), (4) The dark portion of the original comprised an opaque black mask, and (d) Time of exposure was 4 seconds.

Charging:

(a) Magnitude—positive 7 kilovolts on the corona wires and grid bias set at 1250 volts positive all with respect to the conducting layer 13, (b) Time of charging—4 seconds simultaneous with exposure and then continued for an additional 1 second in the dark, and (c) Construction of corona charger—corona wires were 0.001 inch (25 micrometers) in diameter. Grid has 8 lines per inch (2.54 cm) and was oscillated while charging. Active charging area was about 5 inches by 7 inches (12 cm by 17 cm).

Flooding and Developing:

(a) Intensity of the Xenomega enlarger—with lens at f/4.5 and Kodak Wratten No. 2B and a 725 nanometer cutoff interference filter permanently in the beam, the power density at the exposure plane was 330 microwatts/cm$^2$, (b) Spacing—the rinse and development heads were spaced about 0.020 inch (0.5 millimeter) from the insulating surface of the recording element, (c) Development time—about 4 seconds.

(d) First flood and development:

(1) Filter pack—Kodak Wratten No. 29 (red) filter, (2) Developer—positively charged cyan colored toner particles in Isopar G, (3) Time—10 seconds flood prior to development plus 10 seconds flood while developing.

(e) Second flood and development:

(1) Filter pack—two thicknesses of a Kodak Wratten No. 47B (blue) filter, (2) Developer—positively charged yellow colored toner particles in Isopar G, (3) Time—1 second flood prior to developing plus 10 seconds flood while developing.

Transfer:

(a) Electrostatic—2 kilovolts positive applied to the recording element with respect to a grounded gel roller. A piece of insulator-coated paper was used as the receiver sheet. The color print was fused at 100° C. for 30 seconds.

(b) Adhesive—4 inch wide Scotch Magic tape (manufactured by the Minnesota Mining and Manufacturing Company) was used to transfer the color print from the recording element to the above receiver sheet.

EXAMPLE 2

A recording element containing three selectively-conductive, composite photoconductive layers was fabricated in the following manner. A blue-sensitive photoconductor was prepared by dissolving 120.0 grams of Lexan 145 in 1560 ml of tetrahydrofuran (hereinafter referred to as THF) containing 6.0 grams of surfactant solution (10% weight/weight in THF) with rapid stirring. The surfactant is the same block copolymer as in Example 1, hereinafter referred to as surfactant solution. After solution was obtained, 49.60 grams (0.22 mole) of 2-nitrodibenzothiophene and 62.16 grams (0.22 mole) of tri-p-tolylamine were added. This solution was filtered and set aside. 68.24 grams (0.22 mole) of 2,4,7-trinitro-9-fluorenone (hereinafter referred to as TNF) was dissolved in 700 ml of THF and filtered as above. The TNF solution was added to the Lexan solution and mixed thoroughly. This solution was then coated at 0.60 g/ft$^2$ dry coverage on a transparent, electrically conducting film support subbed with a thin layer of an adhesive polymeric material to form a blue-sensitive emitter layer.

Next, a solution containing 110.0 grams Lexan 145, 10.0 grams ethylene terephthalate-neopentylglycol polymer, (hereinafter referred to as ETN) 80.0 grams of tri-p-tolylamine and 9.6 grams surfactant solution (10% weight/weight in $CHCl_3$) in 960 ml $CHCl_3$ was prepared and filtered. This solution was coated directly on the above element at 1.0 g/ft$^2$ dry coverage.

Finally, a solution containing 110.0 grams Lexan 145, 10.0 grams ETN, 60.0 grams tri-p-tolylamine, 20.0 grams 4-(di-p-tolylamino)-4'-[4-(di-p-tolylamino)-$\beta$-styryl]stilbene and 9.6 grams surfactant solution (10% weight/weight in $CHCl_3$) in 1220 ml $CHCl_3$ was prepared and filtered. This solution was coated directly on the above element at 0.25 g/ft$^2$ dry coverage. This two-step coating procedure produces a charge-transport and yellow filter layer for the blue-sensitive photoconductor.

A barrier layer was prepared by dissolving 66.4 grams of cellulose nitrate in 1356 ml methanol diluted with 232 ml n-butanol after all the cellulose nitrate had dissolved. After filtration, this solution was directly coated on the blue-sensitive photoconductive element described above at 0.075 g/ft$^2$ dry coverage.

A green-sensitive photoconductor was prepared by dissolving 36.35 grams of 9-anthronitrile (0.18 mole) in 500 ml of refluxing methylene chloride and filtering by gravity to remove insoluble material. Concurrently, a solution of TNF (57.4 grams, 0.18 mole) in 725 ml of refluxing methylene chloride was prepared and filtered. The latter solution was stirred rapidly while the hot 9-anthronitrile solution was added slowly thereto at a constant rate. Bright orange-red crystals separated from the reaction mixture. The mixture was stirred and cooled to room temperature to complete crystallization. Filtration, washing with liberal amounts of methylene chloride, and drying yielded 63.6 grams (68%) of 9-anthronitrile:TNF complex. To a solution of 24.0 grams Geon 222 (vinyl chloride/vinylidene chloride 40/60 from B. F. Goodrich Rubber Co.) and 12.9 grams tri-p-tolylamine in 105 ml toluene containing 2.25 grams surfactant solution (10% weight/weight in toluene) was added 23.1 grams of the 9-anthronitrile:TNF complex and 400 grams Zirconia beads (a ball milling material manufactured by the Zircoa Corporation of Solon, Ohio) of −6 to +10 mesh, 0.125" diameter. This mixture was prepared in duplicate and each batch was placed in a polypropylene container and milled on a paint shaker for 3.5 hours. The resulting milled dispersions were combined, diluted with 580 ml toluene, filtered to remove the Zirconia beads, and coated on the cellulose nitrate barrier layer at 0.25 g/ft$^2$ dry coverage. The dispersion was stirred throughout the coating operation to insure uniformity.

A solution of 20.0 grams Lexan 145 in 135 ml $CHCl_3$ containing 6.0 grams surfactant solution (10% weight/-weight in $CHCl_3$) was prepared as above. To this solution was added 20.0 grams Electra Red (Harmon Colors; Color Index No. 21200, Pigment Red 41) and 400 grams Zirconia beads (−6 to +10 mesh, 0.125" diameter). The resulting mixture was milled on a paint shaker for three hours in a polypropylene container. To the dispersion so obtained was added a solution of 90.0 grams Lexan 145, 10.0 grams ETN and 60.0 grams tri-p-tolylamine in 630 ml $CHCl_3$. The dispersion was filtered to remove the Zirconia beads and coated on the above element at 1.35 g/ft$^2$ dry coverage. The dispersion was stirred throughout the coating operation to insure uniformity. This two step coating procedure produces a green-sensitive photoconductor having a green-sensitive emitter layer and a charge-transport layer containing a red filter.

The above-described cellulose nitrate solution was then coated at 0.075 g/ft$^2$ dry coverage on the green-sensitive photoconductive element described above to provide a second barrier layer.

A red-sensitive photoconductive layer was prepared by adding 2.4 grams of Geon 222 to 138 ml toluene. To this solution was added 10.0 grams of isolated aggregate crystals consisting of a co-crystalline complex of a thiapyrylium dye and Lexan 145 as described in U.S. Pat. No. 3,732,180, the disclosure of which is incorporated herein by reference, and 300 grams Zirconia beads (−6 to +10 mesh, 0.125" diameter). This mixture was prepared in duplicate, and both batches were placed in polypropylene containers and milled on a paint shaker for 3.5 hours. The resulting dispersions were combined, diluted with 268 ml toluene, and filtered as above to remove the Zirconia beads. The mixture was stirred to maintain uniformity and coated on the above element at 0.10 g/ft$^2$ dry coverage.

A solution of 110.0 grams Lexan 145, 10.0 grams ETN, 80.0 grams tri-p-tolylamine and 9.6 grams surfactant solution (10% weight/weight in $CHCl_3$) in 960 ml $CHCl_3$ was prepared, filtered, and coated at 1.50 g/ft$^2$ on the above element. This two step coating procedure produces a red-sensitive photoconductor having a red-sensitive emitter layer and a charge-transport layer.

To complete the recording element for development purposes, a length of 0.5-mil Mylar film subbed with a polymeric adhesive was heat laminated to the red-sensitive photoconductor.

A positive-to-positive three-color print was made with the above-described recording element using the apparatus of FIGS. 3, 3*a*, 4 and 4*a*. To produce the print, the recording element was uniformly charged to a negative potential of approximately 1450 volts by the grid controlled charger unit 40 and simultaneously exposed by projecting a color original from the source 54 consisting of adjacent bands of blue, red and green Kodak Wratten filters along with clear and dark regions. The recording element was then flooded with red light provided by projecting light from the xenon source 60 through a red filter contained in the filter wheel 62. Upon termination of the red flood exposure, the recording element was developed using negatively charged cyan colored toner particles in the development head 66, a positive bias potential of 1450 volts applied to the conducting layer 13 of the recording element by the source 69 and the development head 66 and rinse head 68 grounded. The filter wheel 62 was then rotated to position a green filter in the light beam provided by the xenon source 60. Upon termination of the green flooding light, the development station 76, identical to the development station 64 except that the development head 78 contained negatively charged magenta colored toner particles in Isopar G, was positioned adjacent the insulating layer of the recording element while a bias potential of 1300 volts positive was applied to the conducting layer 13 of the recording element and the development head 78 and rinse head 80 were grounded. Finally, the recording element was flooded with blue light and then developed by the development station 70 using negatively charged yellow colored toner particles in the development head 72, a positive bias potential of 1100 volts on the conducting layer 13 of the recording element and the development head 72 and the rinse head 74 grounded. The resulting image was allowed to dry and then transferred from the recording element to a receiver sheet using Scotch Magic tape. Pertinent data for the processing of this recording element is listed below:

Exposure:

(a) Intensity of the xenographic projector—power density at the exposure plane was 4,300 microwatts/cm$^2$, (b) Permanent filters—two thicknesses of a CC30M color compensating filter and a 725 nanometer (nm) interference cutoff filter were permanently positioned in the light beam, of the xenographic projector, (c) The color original (1) The blue portion of original comprised a Kodak Wratten No. 36 filter and a Kodak Wratten No. 98 filter, (2) The red portion of original comprised a Kodak Wratten No. 70 filter, (3) The green portion of original comprised a Kodak Wratten No. 74 filter, (4) The clear portion of original comprised a Kodak Wratten No. 96 filter (1.0 ND), (5) The dark portion of original comprised a block mask, and (d) Time of exposure was 3 seconds.

Charging:

(a) Magnitude—negative 10 kilovolts on the corona wires with the grid bias set at negative 1450 volts all with respect to the conducting layer 13, (b) Time of charging—2 seconds simultaneous with exposure, and (c) Construction of corona charger—identical to that of Example 1.

Flooding and Development:

(a) Spacing and rate of development—identical with that of Example 1, (b) First flood and development:

(1) Filter pack—a Kodak Wratten No. 70 filter with a resultant power density of 850 microwatts/cm$^2$ at the exposure plane, (2) Developer—negatively charged cyan colored toner particles in Isopar G, (3) Time—3 seconds flood prior to developing.

(c) Second flood and development:

(1) Filter pack—a Kodak Wratten No. 74 filter with a resultant power density of 540 microwatts/cm$^2$, (2) Developer—negatively charged magenta colored toner particles in Isopar G, (3) Time—5 seconds flood prior to developing.

(d) Third flood and development:

(1) Filter pack—two thicknesses of a Kodak Wratten No. 47B filter with a resultant power density of 690 microwatts/cm$^2$, (2) Developer—negatively charged yellow colored toner particles in Isopar G, (3) Time—8 seconds flood prior to developing.

EXAMPLE 3

A red-sensitive photoconductor was prepared by adding 2.26 grams of 4-4(dimethylaminophenyl)-2,6-diphenyl thiapyrylium fluoroborate to 1200 grams of methylene chloride. The solution was allowed to stir overnight. Lexan 145 (135.9 grams) was added slowly, with rapid stirring to the above solution and allowed to stir one hour after the final portion had been added. Bis(4-diethylamino-2-methylphenyl) phenylmethane (90.6 grams) was added and the solution was stirred for one hour. The solution was then sheared 80 minutes in a blender. Finally, 12.8 grams of a 10% weight/weight SF-1066 (a copolymer of dimethylpolysiloxane and a polyoxyalkylene ether from General Electric Co.) in methylene chloride was added and the resulting solution filtered and coated on an unsubbed electrically conductive polyester film support at 1.30 g/ft$^2$ dry coverage.

In a separate procedure, a blue-green multilayer coating was prepared in a manner similar to that described in Example 2 above.

A length of the red-sensitive photoconductor was laminated at 250° F. to a length of the blue-green multilayer; and the support on the red-sensitive coating was then stripped off. This procedure was repeated so that two thicknesses of the red-sensitive layer were applied to the blue-green multilayer. To complete this element for the development process, a length of a 0.5-mil (13 micrometers) Mylar film support subbed with a thin layer of a polymeric adhesive was laminated to the above multilayer structure using the conditions described above. This recording element was then processed utilizing the apparatus of FIGS. 3, 3*a*, 3*b*, 4 and 4*a* in a manner similar to that described in Example 2 to produce a positive-to-positive three-color print. The data for processing of this recording element is listed below:

Exposure:

(a) Intensity of the xenographic projector—power density at the exposure plane was 4300 microwatts/cm$^2$, (b) Permanent filters—two thicknesses of a CC30M color compensating filter and a 725 nanometer (nm) interference cutoff filter were permanently in the light beam of the xenographic projector, (c) The color original (1) The blue portion of the original comprised a Kodak Wratten No. 36 filter and a Kodak Wratten No. 98 filter, (2) The red portion of the original comprised a Kodak Wratten No. 70 filter, (3) The green portion of the original comprised a Kodaka Wratten No. 12 filter and a Kodak Wratten No. 61 filter, (4) The clear portion of the original comprised a Kodak Wratten No. 96 filter (1.0 ND), (5) The dark portion of the original comprised a black mask, and (d) Time of exposure was 3 seconds.

Charging:

(a) Magnitude—negative 10 kilovolts on the corona wires with the grid bias set at 1900 volts negative all with respect to the conducting layer 13, (b) Time—3 seconds simultaneous with exposure, (c) Construction of corona charger—identical with that of Example 1.

Flooding and Development:

(a) Spacing and development rate—identical with that of FIG. 1, (b) First flood and development:

(1) Filter pack—a Kodak Wratten No. 70 filter with a resultant intensity of 850 microwatts/cm$^2$ at the exposure plane, (2) Developer—negatively charged cyan colored toner particles in Isopar G, (3) Time—10 seconds flood prior to developing, (4) Developer bias potentials—1760 volts positive on the recording element, development and rinse heads grounded.

(c) Second flood and development:

(1) Filter pack—a Kodak Wratten No. 12 filter and a Kodak Wratten No. 61 filter with the resultant power density of 600 microwatts/cm$^2$ at the exposure plane, (2) Developer—negatively charged magenta colored toner particles in Isopar G, (3) Time—4 seconds prior to developing, (4) Developer biases plus 1570 volts on the recording element, development and rinse heads grounded.

(d) Third flood and development:

(1) Filter pack—two thicknesses of a Kodak Wratten No. 47B filter with the resultant power density of 530 microwatts/cm$^2$ at the exposure plane, (2) Developer—negatively charged yellow colored toner particles in Isopar G, (3) Time—10 seconds flood prior to developing, (4) Developer bias potentials—1280 volts positive on a recording element, developer and rinse heads grounded.

Transfer:

(a) Adhesive—4 inch wide Scotch Magic tape was used to transfer the print from the recording element to a receiver sheet.

The invention has been described in detail with particular reference to preferred embodiments thereof but it will be understood that variations and modifications can be effected within the spirit and scope of the invention. For example, a number of insulator overcoats known in the art can be substituted for the described Mylar layer. If desired, such insulator overcoat can be transparent and the exposure to the color original can be made therethrough.

Persistent photoconductive layers may be utilized in the invention. With the use of persistent photoconductive layers, the recording element can be exposed first without charging prior to, or simultaneously with, the image exposure. The multilayer recording element would then be charged with a grid-controlled charger, charging only the unexposed areas. Flooding and development steps would then follow as outlined in the above examples. Elements of this type could probably not be reused until the persistent conductivity decayed. However, it might be possible to find a set of persistent photoconductive layers which would exhibit persistent conductivity at high intensities but could be discharged at a lower intensity flood light and thus rapidly destroy the persistent conductivity areas. This would allow the production of multiple copies of a color document with only single exposure.

The inventive process may be utilized with a recording element containing a separable insulating layer. After preparing the photosensitive portion of the element as in the above examples, a piece of 0.5-mil Mylar can be held in intimate contact with the element while the element is exposed and developed in the manner described above. The Mylar sheet would then be removed and taped face down to a piece of white paper or viewed as a transparency. This affords a three-color image as in the previous examples. Use of an element comprising a separable or separate insulating layer avoid the difficulty inherent in electrical charges being stored in a permanently affixed overcoat layer, since a fresh piece of insulating sheet can be used for each cycle. Furthermore, the need for transfer of the image from the insulator to a receiver is obviated because the entire insulator is transferred although a separate transfer step could be included. A piece of insulating paper might also be used in place of the Mylar; this would allow toning to occur directly on the final receiver. Alternatively, a temporary image could be transferred to the insulator web followed by a subsequent transfer to a paper receiver.

A negative-to-positive color print can be produced by first charging only the insulating layer of the recording element to one polarity and then by reversing the corona polarity and grounding the grid, charging the recording element while exposing it to a color original. The charging of only the insulating layer could be accomplished by white light flooding the photoconductor layers while charging. The light flooding and development steps would be similar to the positive-to-positive process.

We claim:

1. A unitary electrophotographic recording element having an imaging surface and adapted for use in producing multicolor images thereon, said element comprising:

(a) an electrically conductive layer;

(b) a first photoconductive member comprising a charge transport layer and an emitter layer which is responsive substantially only to light of a first color and substantially transparent to light of other colors;

(c) a second photoconductive member comprising a charge transport layer and an emitter layer which is responsive to light of a second color and substantially transparent to light of a third color;

(d) a third photoconductive member comprising a charge transport layer and an emitter layer responsive to light of a third color; and (e) an electrically insulating layer;

said layers each being substantially continuous and arranged at different locations across the thickness of said element with said photoconductive members and said insulating layer all between said conductive layer and said imaging surface, said photoconductive layers and said conductive layer being disposed so as to allow charge migration therebetween and at least one of said conductive and insulating layers being substantially transparent to light in the visible region of the spectrum.

2. The color electrophotographic recording element defined in claim 1 wherein said charge transport layer of said first photoconductive member includes a filter material spectrally absorptive of said first color and said charge transport layer of said second photoconductive member includes a filter material spectrally absorptive of said second color.

3. The color electrophotographic recording element defined in claim 1 further comprising at least one transparent chemical barrier layer disposed between said conducting and insulating layers.

* * * * *